US010292440B2

(12) United States Patent
Fernando et al.

(10) Patent No.: US 10,292,440 B2
(45) Date of Patent: May 21, 2019

(54) SUPPORTED GLOVE HAVING AN ABRASION RESISTANT NITRILE COATING

(71) Applicant: Ansell Limited, Richmond, Victoria (AU)

(72) Inventors: Koshali Fernando, Moratuwa (LK); Amani Mathota, Kiribathgoda (LK); Karavita Arachchige Dharshana Abayaweera, Heiyanthuduwa (LK); Sanjeewa Herath, Colombo (LK); Paul Saunders, Chorley (GB)

(73) Assignee: Ansell Limited, Victoria (AU)

( * ) Notice: Subject to any disclaimer, the term of this patent is extended or adjusted under 35 U.S.C. 154(b) by 386 days.

(21) Appl. No.: 15/066,356

(22) Filed: Mar. 10, 2016

(65) Prior Publication Data

US 2016/0262469 A1 Sep. 15, 2016

Related U.S. Application Data

(60) Provisional application No. 62/130,712, filed on Mar. 10, 2015.

(51) Int. Cl.
*A41D 19/00* (2006.01)
*A41D 19/015* (2006.01)

(52) U.S. Cl.
CPC ... *A41D 19/0065* (2013.01); *A41D 19/01505* (2013.01); *A41D 19/01558* (2013.01); *A41D 2500/10* (2013.01); *A41D 2500/54* (2013.01)

(58) Field of Classification Search
CPC ..... A41D 16/0096; A41D 19/0065; A41D 19/001; A41D 19/01505; A41D 19/01558; A41D 2500/10; A41D 2500/54
See application file for complete search history.

(56) References Cited

U.S. PATENT DOCUMENTS

| | | | |
|---|---|---|---|
| 1,719,633 | A | 7/1929 | Teague |
| 1,993,233 | A | 3/1935 | Winchester |
| 2,293,928 | A | 8/1942 | Beal |
| 2,324,735 | A | 7/1943 | Spanel |
| 2,353,877 | A | 7/1944 | Chollar |
| 2,393,298 | A | 1/1946 | De Laney et al. |
| 2,434,035 | A | 1/1948 | De Laney et al. |
| 2,503,139 | A | 4/1950 | Fabregues-Boixar |

(Continued)

FOREIGN PATENT DOCUMENTS

| | | |
|---|---|---|
| EP | 0824896 A1 | 2/1998 |
| FR | 2448307 A1 | 9/1980 |

(Continued)

OTHER PUBLICATIONS

"Encyclopaedia Chimica 2", 28th impression of reduced edition, Mar. 15, 1984, published by Kyoritsu Publishing Co., Ltd., pp. 840-841.

(Continued)

*Primary Examiner* — Arti Singh-Pandey
(74) *Attorney, Agent, or Firm* — Moser Taboada

(57) ABSTRACT

A glove, including an 18 gauge knitted liner, a foamed nitrile coating disposed on at least a portion of the knitted liner; and a plurality of cavities disposed on a surface and throughout the foamed nitrile coating, wherein the glove exhibits an EN level 4 abrasion resistance and methods of making the glove are disclosed.

18 Claims, 4 Drawing Sheets

(56) References Cited

U.S. PATENT DOCUMENTS

| | | | |
|---|---|---|---|
| 2,526,431 | A | 10/1950 | Strickhouser |
| 2,642,335 | A | 6/1953 | Ewart et al. |
| 2,867,849 | A | 1/1959 | Drew et al. |
| 2,873,450 | A | 2/1959 | Brodeur, Jr. |
| 2,997,746 | A | 8/1961 | O'Brien et al. |
| 3,869,726 | A | 3/1975 | Bell |
| 3,934,062 | A | 1/1976 | Tillotson et al. |
| 4,082,862 | A | 4/1978 | Esemplare et al. |
| 4,143,109 | A | 3/1979 | Stockum |
| 4,218,779 | A | 8/1980 | Collyer et al. |
| 4,283,244 | A | 8/1981 | Hashmi |
| 4,284,275 | A | 8/1981 | Fletcher |
| 4,329,312 | A | 5/1982 | Ganz |
| 4,463,156 | A | 7/1984 | McGary, Jr. et al. |
| 4,497,072 | A | 2/1985 | Watanabe |
| 4,519,098 | A | 5/1985 | Dunmire et al. |
| 4,536,890 | A | 8/1985 | Barnett et al. |
| 4,555,813 | A | 12/1985 | Johnson |
| 4,589,940 | A | 5/1986 | Johnson |
| 4,779,290 | A | 10/1988 | Welch et al. |
| 5,070,540 | A | 12/1991 | Bettcher et al. |
| 5,098,755 | A | 3/1992 | Tanquary et al. |
| 5,284,607 | A | 2/1994 | Chen |
| 5,304,337 | A | 4/1994 | Chen et al. |
| 5,438,709 | A | 8/1995 | Green et al. |
| 5,500,469 | A | 3/1996 | Johnsen et al. |
| 5,632,045 | A | 5/1997 | Chase et al. |
| 5,649,326 | A | 7/1997 | Richard, Jr. et al. |
| 5,712,346 | A | 1/1998 | Lee |
| 5,822,791 | A | 10/1998 | Baris |
| 5,948,707 | A | 9/1999 | Crawley et al. |
| 5,977,223 | A | 11/1999 | Ryan et al. |
| 5,993,923 | A | 11/1999 | Lee |
| 6,019,922 | A | 2/2000 | Hassan et al. |
| 6,075,081 | A | 6/2000 | Nile et al. |
| 6,081,928 | A | 7/2000 | Bourne |
| 6,254,947 | B1 | 7/2001 | Schaller |
| 6,306,514 | B1 | 10/2001 | Weikel et al. |
| 6,347,409 | B1 | 2/2002 | Nile et al. |
| 6,378,137 | B1 | 4/2002 | Hassan et al. |
| 6,391,409 | B1 | 5/2002 | Yeh et al. |
| 6,440,498 | B2 | 8/2002 | Schaller |
| 6,526,593 | B2 | 3/2003 | Sajovic |
| 6,527,990 | B2 | 3/2003 | Yamashita et al. |
| 6,675,392 | B2 | 1/2004 | Albert |
| 6,732,735 | B1 | 5/2004 | Snell |
| 6,745,403 | B2 | 6/2004 | Sajovic |
| 7,037,579 | B2 | 5/2006 | Hassan et al. |
| 7,771,644 | B2 | 8/2010 | Flather et al. |
| 7,814,570 | B2 | 10/2010 | Hassan et al. |
| 2001/0011387 | A1 | 8/2001 | Yamashita et al. |
| 2001/0053421 | A1 | 12/2001 | Schaller |
| 2002/0035744 | A1 | 3/2002 | Kolcio et al. |
| 2003/0033660 | A1 | 2/2003 | Sajovic |
| 2003/0037364 | A1 | 2/2003 | Albert |
| 2003/0221239 | A1 | 12/2003 | Modha et al. |
| 2004/0122382 | A1 | 6/2004 | Johnson et al. |
| 2005/0015888 | A1 | 1/2005 | Altmann et al. |
| 2006/0008631 | A1 | 1/2006 | Takeyama et al. |
| 2006/0068140 | A1 | 3/2006 | Flather et al. |
| 2006/0143767 | A1 | 7/2006 | Yang et al. |
| 2008/0199354 | A1 | 8/2008 | Gordon |
| 2009/0053312 | A1 | 2/2009 | Berndt |
| 2009/0061751 | A1 | 3/2009 | Polsky |
| 2009/0071424 | A1 | 3/2009 | Takenaka et al. |
| 2009/0077713 | A1 | 3/2009 | Saunders et al. |
| 2009/0105424 | A1 | 4/2009 | Kodama et al. |
| 2009/0158499 | A1 | 6/2009 | Singer |
| 2009/0253810 | A1 | 10/2009 | Katz |
| 2009/0255033 | A1 | 10/2009 | Chen et al. |
| 2009/0280470 | A1 | 11/2009 | Fare et al. |
| 2009/0292081 | A1 | 11/2009 | Suddaby |
| 2012/0137404 | A1 | 6/2012 | Lipinski |
| 2013/0291283 | A1 | 11/2013 | Hassan et al. |
| 2014/0000006 | A1* | 1/2014 | Perera et al. .... A41D 19/01505 2/167 |

FOREIGN PATENT DOCUMENTS

| | | | |
|---|---|---|---|
| GB | 418240 | A | 10/1934 |
| JP | S5227899 | A | 3/1977 |
| JP | S5250902 | A | 4/1977 |
| JP | S5490362 | A | 7/1979 |
| JP | S55148919 | U | 10/1980 |
| JP | S55163202 | A | 12/1980 |
| JP | S58184512 | A | 10/1983 |
| JP | S6211117 | A | 1/1987 |
| JP | S6351864 | A | 3/1988 |
| JP | H01258917 | A | 10/1989 |
| JP | H0621364 | A | 1/1994 |
| JP | H0621365 | A | 1/1994 |
| JP | H06238683 | A | 8/1994 |
| JP | H11192663 | A | 7/1999 |
| JP | 2001232653 | A | 8/2001 |
| JP | 2001295114 | A | 10/2001 |
| JP | 2002020913 | A | 1/2002 |
| JP | 2002129418 | A | 5/2002 |
| JP | 2002249909 | A | 9/2002 |
| SU | 711051 | A1 | 1/1980 |
| WO | WO-0019847 | A1 | 4/2000 |
| WO | WO-02052965 | A1 | 7/2002 |
| WO | WO-03102058 | A1 | 12/2003 |
| WO | WO-2005002375 | A1 | 1/2005 |

OTHER PUBLICATIONS

"Non-Final Office Action", U.S. Appl. No. 10/882,016, dated Nov. 18, 2004, pp. 21.

Written Opinion dated Nov. 23, 2004 for PCT Application No. PCT/US04/21295.

"Non-Final Office Action", U.S. Appl. No. 10/882,016, dated Apr. 29, 2005, pp. 24.

"Final Office Action", U.S. Appl. No. 10/882,016, dated Oct. 19, 2005, pp. 29.

International Search Report and Written Opinion dated Jan. 17, 2006 for PCT Application No. PCT/US2005/001002.

"Non-Final Office Action", U.S. Appl. No. 10/882,016, dated Jul. 5, 2006, pp. 17.

"Final Office Action", U.S. Appl. No. 10/882,016, dated Mar. 9, 2007, pp. 23.

"Non-Final Office Action", U.S. Appl. No. 11/035,366, dated Jun. 5, 2007, pp. 17.

"Non-Final Office Action", U.S. Appl. No. 10/882,016, dated Jan. 18, 2008, pp. 6.

"Non-Final Office Action", U.S. Appl. No. 10/882,016, dated Jun. 30, 2008, pp. 9.

"Final Office Action", U.S. Appl. No. 10/882,016, dated Dec. 9, 2008, pp. 12.

Supplemental European Search Report dated Dec. 30, 2008 for Application No. 04756576, pp. 3.

"Non-Final Office Action", U.S. Appl. No. 10/882,016, dated Aug. 7, 2009, pp. 6.

"Non-Final Office Action", U.S. Appl. No. 12/106,711, dated Oct. 8, 2009, pp. 7.

"Non-Final Office Action", U.S. Appl. No. 11/639,017, dated Feb. 2, 2010, pp. 9.

"Non-Final Office Action", U.S. Appl. No. 11/706,536, dated Feb. 4, 2010, pp. 9.

"Final Office Action", U.S. Appl. No. 11/706,536, dated Aug. 18, 2010, pp. 10.

"Final Office Action", U.S. Appl. No. 11/639,017, dated Aug. 25, 2010, pp. 11.

European Search Report dated Dec. 12, 2011 for Application No. EP11185956.

European Communication and Search Report dated Jan. 20, 2012 for Application No. 11176171.4.

(56) References Cited

OTHER PUBLICATIONS

European Office Action dated Jan. 23, 2013 for Application No. 11185956.7.
International Search Report and Written Opinion dated Dec. 22, 2015 for PCT Application No. PCT/AU2015/000614.
Rompp Lexikon, Chemie, Prof. Dr. Jiirgen Falbe; Prof. Dr. Manfred Regitz, pp. 2.
"Photograph of Towa Micropore and Ansell Oil Grip", p. 1.

* cited by examiner

SUPPORTED GLOVE HAVING AN ABRASION RESISTANT NITRILE COATING

CROSS-REFERENCE TO RELATED APPLICATIONS

This application claims the benefit of priority to U.S. Provisional Application No. 62/130,712, filed on Mar. 10, 2015, which is incorporated by reference in its entirety.

BACKGROUND

Field of the Invention

Embodiments according to the present invention generally relate to a glove and, more particularly, to a supported glove comprising an abrasion resistant nitrile elastomeric coating disposed on a fabric liner and methods of making a glove having liners coated with abrasion resistant nitrile elastomeric coatings.

Description of the Related Art

Gloves are used in many fields for protecting workers, such as medical, industrial, household, and other industries. During use, gloves are subjected to extensive wear from cuts, punctures, and abrasions, creating a need for durability. Furthermore, other in-service requirements include enhanced grip-ability, stretch-ability, flexibility, and other comfort related properties.

Previous supported gloves specified for various industries, which are often used and re-used many times, consist of a fabric liner, such as 10, 13, or 15 gauge liners, having a latex material disposed thereon, e.g., a natural rubber latex, to form a coating covering the liner. However, such gloves generally comprise thick liners and thick coatings, resulting in inflexible and uncomfortable gloves.

Attempts have been made to provide improved polymeric materials so that the supported gloves are flexible. For example, solvent based polyurethane materials have been used as relatively thin coatings. However, solvent based polyurethane materials have relatively poor abrasion/durability characteristics and may contain residual organic solvents, which are harmful to the environment and are allergenic. Furthermore, polyurethane materials tend to be slippery and, absent additional grip characteristics, such as surface texturizations, are unsatisfactory.

Therefore, a supported glove having improved durability and abrasion resistance, and grip characteristics would represent an advance in the art.

SUMMARY

Supported gloves having an abrasion resistant nitrile coating and methods for making such gloves, in accordance with the present invention, substantially as shown in and/or described in connection with at least one of the figures, as set forth more completely in the claims, are disclosed. Various advantages, aspects, and novel features of the present disclosure, as well as details of an exemplary embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is to be understood that elements and features of one embodiment may be in other embodiments without further recitation and that, where possible, identical reference numerals have been used to indicate comparable elements that are common to the figures.

DETAILED DESCRIPTION

Embodiments of the present invention comprise a thin knitted fabric liner having a thin foamed nitrile coating. In some embodiments, the thin knitted fabric liner may be an 18 gauge knitted liner. In some embodiments, the thin foamed coating is an acrylonitrile-butadiene (NBR) polymeric coating that may be, for example, approximately 0.2-0.6 mm thick disposed on the knitted liner. In at least one exemplary embodiment of the invention, the foamed NBR coating has, as discussed in greater detail below, has texturizing via salt particles embedded therein and thereon. Subsequently, the salt is removed using a solvent, such as water, leaving cavities on the surface of and throughout the coating, which promotes gripping properties. In addition, the salt particles promote cross-linking of the polymeric coating, which unexpectedly enhances the durability, i.e., increases the abrasion-resistance to at least an EN 4 level, of the foamed coating because the salt particles can penetrate bubbles of the foamed NBR coating. Also, in at least one exemplary embodiment of the invention, the foamed NBR coating is adhered directly onto the knitted liner, i.e., without an unfoamed polymeric layer disposed between the knitted liner and the foamed NBR coating having cavities.

The methods for manufacturing the glove optionally comprise applying a coagulant to the knitted liner, and subsequently dipping the knitted liner into a foamed NBR composition, wherein an uncured coating is disposed on at least a portion of the knitted liner, dipping the fabric liner with the uncured foamed NBR coating into a fluidized salt bath, embedding salt particles therein. The knitted liner having the uncured foamed NBR coating and the embedded salt particles are then washed to dissolve the salt particles. The knitted liner and coating are then cured with heat and to form an ultra-lightweight, supported glove having a thin, foamed, textured, abrasion-resistant nitrile coating. Alternatively, the washing step may be performed after the curing step or both before and after the curing step.

In some embodiments of the invention, the NBR composition is optionally a highly-carboxylated foamed NBR composition. A highly-carboxylated acrylonitrile-butadiene in this context indicates a composition comprising approximately 35-40% acrylonitrile, which is particularly oil-resistant, providing enhanced grip properties for oily and watery service applications.

Figure 1:
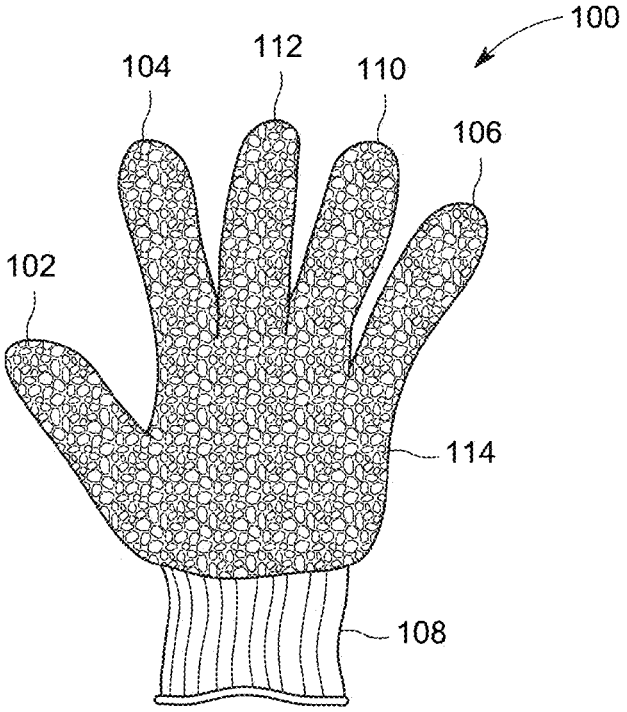
FIG. 1 depicts a knitted liner, according to embodiments of the present invention.

FIG. 1 depicts a knitted liner 100, according to embodiments of the present invention. The knitted liner 100 has seven major components, including a pinky finger 106, a ring finger 110, a middle finger 112, an index finger 104, a thumb 102, a palm component 114, a backhand component (not shown) and, optionally, a cuff 108. Exemplary embodiments of the present invention include wherein the liner 100 is an 18-gauge knitted liner comprising an aliphatic or aromatic nylon, an aramid, or an HPPE yarn and having a thickness of, for example, 0.4-0.8 mm. In some embodiments of the present invention, the aliphatic nylon is nylon-66 and the aramid is an m-aramid, such as NOMEX® or a para-aramid, such as KEVLAR®, and/or the HPPE yarn comprises an ultra-high molecular weight polyethylene fiber, such as DYNEEMA®.

At least one knitted liner comprises a composite, blended, or covered yarn having HPPE fibers and very hard fibers, such as silica, carbide, or glass fibers, as disclosed in commonly-assigned U.S. application Ser. No. 14/451,544, which is incorporated by reference in its entirety. Also, at least one exemplary embodiment comprises a composite yarn, comprising a blended core yarn, comprising about 90% high performance polyethylene stretch broken technical fibers, and about 10% inorganic, mineral, ceramic, or filament fibers having a length substantially similar to a length of the high performance polyethylene stretch broken technical fibers; and at least one wrapping yarn comprising at least one of a high tenacity polyamide or a high tenacity polyester, wherein the at least one wrapping yarn is wrapped around the core to form the composite yarn having an EN5 cut-resistance level and having dimensions that enable the composite yarn to be knitted with an 18 gauge needle.

Also, some yarns may be plaited with a main yarn to create a liner having two or more layers. Further still, some liners may comprise composite yarns having a core yarn, and one or more wrapping yarns. Furthermore, at least one knitted liner comprises a yarn having an elastomeric yarn, such as SPANDEX®, which allows even a snugly fitting liner to stretch and remain flexible.

Embodiments of the invention include fingers, palm, and cuffs that are tapered for a more snug fit. Knitting machines, including those manufactured by Shima Seiki, Mfg., Ltd., as discussed below, can be programmed to accommodate a large number of changes in stitch dimensions using stitch setup and to alter the physical dimensions used in the knitted liner 100. Stitch setup can be used to "customize" knitted liners manufactured in various sizes, such as 6, 7, 8, 9, and 10 and to impart flexibility or reinforcements in various regions of the knitted liners. Also, liners in accordance with embodiments of the invention may be knitted using automatic seamless knitting machines. Seamless knitting machines include, but are not limited to, models NSFG, NSFG-I, SFG-1, and SWG by Shima Seiki Mfg., Ltd. Any knitted liner described herein may also comprise regions or zones of increased stretch or reinforcements, technologies that are disclosed in commonly-assigned U.S. Pat. Nos. 6,962,064; 7,213,419, 7,246,509; and 7,555,921, which are herein incorporated by reference, each in its entirety.

Figure 2:
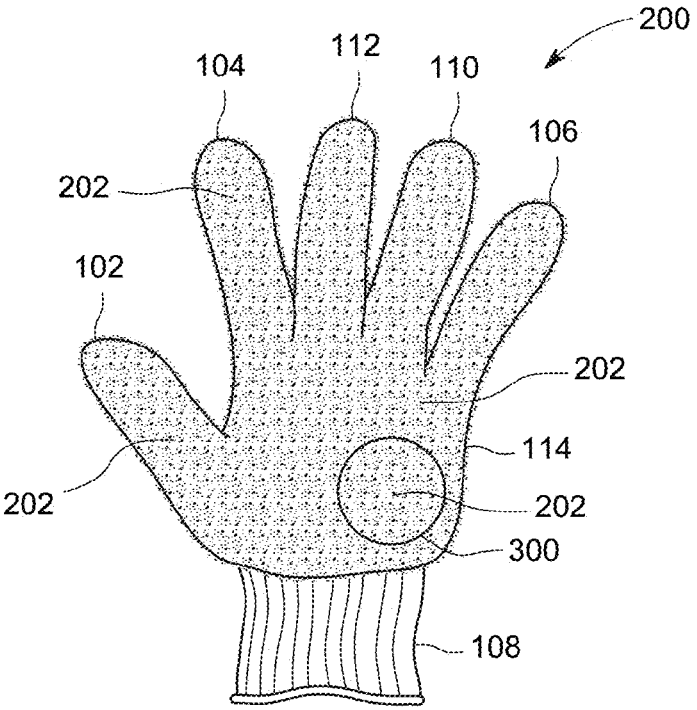
FIG. 2 depicts a knitted liner having a coating disposed thereon to form a glove in accordance with embodiments of the present invention.

FIG. 2 shows the knitted liner 100 having a foamed coating 202 disposed thereon to form a glove 200 in accordance with embodiments of the present invention. The knitted liner 100 has a foamed coating 202 disposed on the thumb 102, the fingers 104, 112, 110, 106, and the palm component 114. The coating 202 can comprise one or more polymeric materials or blends thereof, including thermoplastic and thermoset materials. In some embodiments, the foamed coating 202 comprises a palm-dip, a three-quarters dip, or a full dip, as are known to those in the art. Also shown is a cutaway view of region 300, as discussed further below. At least one exemplary embodiment comprises a foamed coating 202 having a thickness from approximately 0.2-0.6 mm. Furthermore, the foamed coating 202 comprises a breathable, open-celled foam in at least one exemplary embodiment according to the invention. Gloves comprising breathable coatings allow moisture, such as perspiration, with a glove to escape, promoting a more comfortable, hygienic glove.

Figure 3:
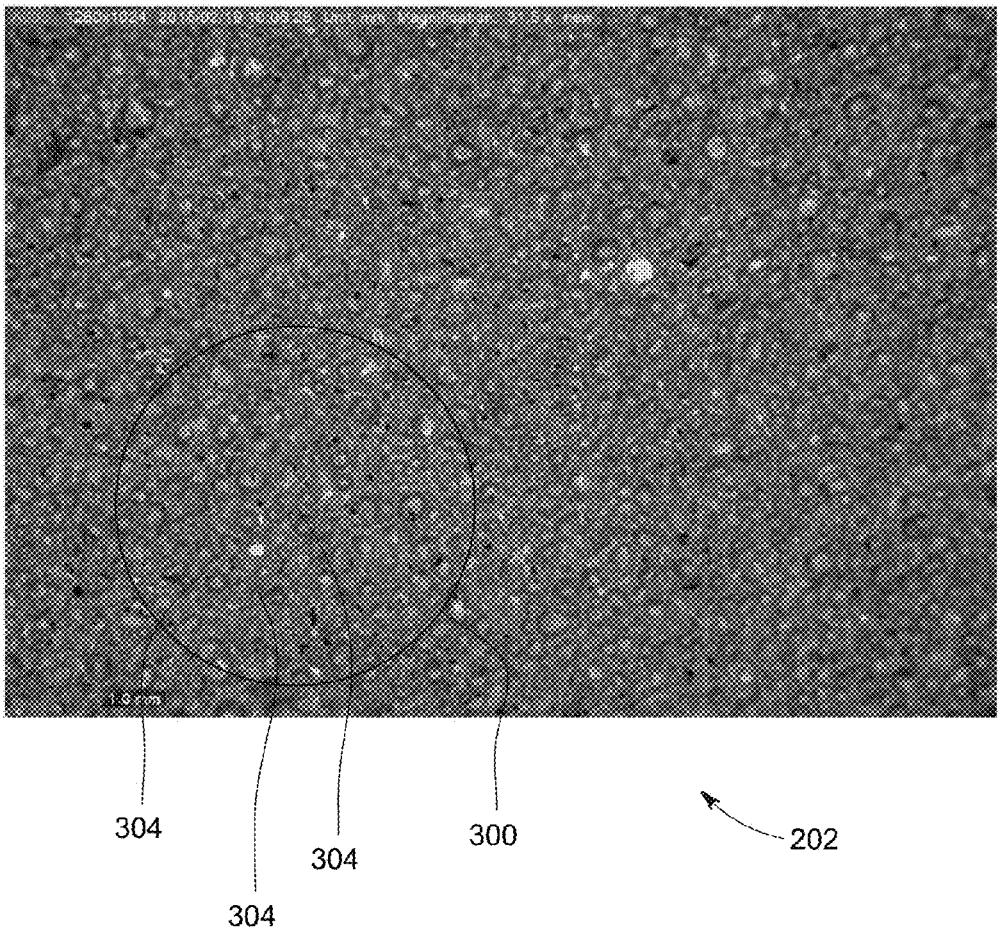
FIG. 3 depicts a region of the coating having a texturized surface of the glove of FIG. 2, according to embodiments of the present invention.

FIG. 3 depicts a region 300 of the foamed coating 202 having a texturized surface of the glove 200 of FIG. 2, according to embodiments of the present invention. The region 300 is a top view of the coating 202 on the palm component 114 taken at approximately 31.5×. A plurality of cavities 302 are depicted on the surface 304 of the coating 202. In at least one exemplary embodiment according to the invention, the volumetric content of air of the coating 202 ranges from approximately 15% to 20%. Foam bubble sizes range from approximately 200 to approximately 400 microns. The plurality of cavities 202 comprise at least one of irregularly-shaped cavities and circularly-shaped cavities.

Gloves according to the invention include wherein the foamed coating 202 comprises natural or synthetic polymeric coatings or compositions, mixtures, or blends thereof. For example, a latex coating may comprise a natural latex, such as guayule or natural polyisoprene, synthetic latexes, such as synthetic polyisoprene, carboxylated acrylonitrile butadiene, non-carboxylated acrylonitrile butadiene, butyl latex, polychloroprene, nitriles, aqueous- and non-aqueous-polyurethanes, styrene-butadiene, and the like, or mixtures or blends thereof. Furthermore, in at least one exemplary embodiment of the present invention, the foamed coating 202 comprises a highly-carboxylated acrylonitrile-butadiene composition or a blend thereof. Thermosetting compositions for the foamed coating 202 include, for example, phenolics, silicones, polyesters, and/or other materials.

One exemplary formulation for a carboxylated nitrile-butadiene composition, according to embodiments, for a coating, such as the foamed coating 202, is shown in Table 1.

TABLE 1

| Ingredient | % in formulation |
|---|---|
| Dispersion of nitrile-butadiene polymer | 75-80 |
| Surfactant | 0-1 |
| Colorant/Pigment | 0.1-5 |
| Vulcanization agent(s) | 2-7 |
| Various additives | 0-7 |
| Thickener(s)/Rheology modifier(s) | 0.1-5 |

The nitrile composition, as shown in Table 1, comprises a low viscosity, for example, a viscosity ranging from 250-750 centipoises and has commonly used stabilizers including but not limited to potassium hydroxide, ammonia, sulfonates, and others known to those of skill in the art. In at least one exemplary embodiment, the viscosity of the composition is approximately 500 centipoises. Also, the total solids content of the composition according to the invention ranges from approximately 28-46%.

The temperature of the elastomeric, polymeric, or latex composition may be controlled, as is known in the art, and may include additives, such as surfactants, to control or modify the physical properties of the composition and/or resulting article formed thereby. In some embodiments, the temperature of the nitrile composition during a dipping process ranges from 10-30° C. and, in at least one embodiment according to the invention, the temperature is approximately 23-25° C.

In at least one embodiment of the invention, a foamed low viscosity NBR composition, combined with a novel coagulant formulation disposed on the fabric liner, and the salt particles used in the fluidized salt bath, produces a supported glove that is breathable and has enhanced abrasion resistance and grip properties as discussed further below. Moreover, gloves comprising the foamed low viscosity NBR composition exhibit little to no strikethrough, and the foamed coating adheres well to an 18 gauge liner despite penetrating less than half the distance from an external surface of the liner to the internal skin-contacting surface, i.e., very little to no strikethrough.

Embodiments according to the present invention further comprise a foamed composition of Table 1 having air content in a 5 to 50% range on a volume basis. The foamed nitrile composition may contain additional surfactants such as TWEEN 20 to stabilize the foamed composition. Once the composition is foamed with the desired air content and the viscosity is adjusted, refinement of the foamed composition is undertaken by stirring the composition with an impeller driven at a fast speed and using a different impeller run at a reduced speed to refine a bubble size as is known to those of skill in the art. Bubble sizes range from approximately 200 microns to approximately 400 microns in diameter. Methods for incorporating high air contents are described in Woodford et al., U.S. Pat. No. 7,048,884, which is commonly-assigned and incorporated herein in its entirety.

Foamed polymeric compositions having a higher viscosity do not penetrate the interstices between the yarns in the knitted liner and may require a higher depth of immersion of the former having the dressed knitted liner. However, the foamed composition adheres well to the knitted liner and need not, for example, penetrate half the thickness of the liner. Also, the air cells reduce the modulus of elasticity of the coating, of which the polymeric composition is comprised, increasing the flexibility of the glove. The air content in the range of 5 to approximately 15 volumetric percent results in foams that have closed cells, creating a foamed coating that is liquid impervious and has a spongy, soft feel, which is nonetheless capable of providing enhanced grip properties due to a surface having cavities.

Also, embodiments according to the invention comprise compositions, and coatings, having volumetric air contents in the range of 15-50%, wherein the air cells that are adjacent to each other expand during a vulcanization heating step, touch each other, and merge. This process creates open-celled foams having an intra-foam network of cells in fluid communication with each other. Open-celled foams absorb even greater amounts of liquids, such as oils and water, drawing liquids into an internal matrix of the coating, further enhancing the grip properties of a glove made therewith. For example, if a drop of liquid is placed on a glove in the palm portion, the liquid penetrates the polymeric coating cells, as opposed to a closed-celled foam, which, other than its surface, is impervious to liquids. Some air cells, whether an open-celled or close-celled foam are disposed on an external surface of the coating, providing increased roughness. For example, any embodiment disclosed herein may comprise a foamed coating in which air cells burst, leaving an open cell. Oil and/or water are wicked from the surface of an article that is gripped, creating locations for the oil and/or water to travel, which allows the surface of the foam to contact the article, thereby providing enhanced gripping capability.

Figure 4:
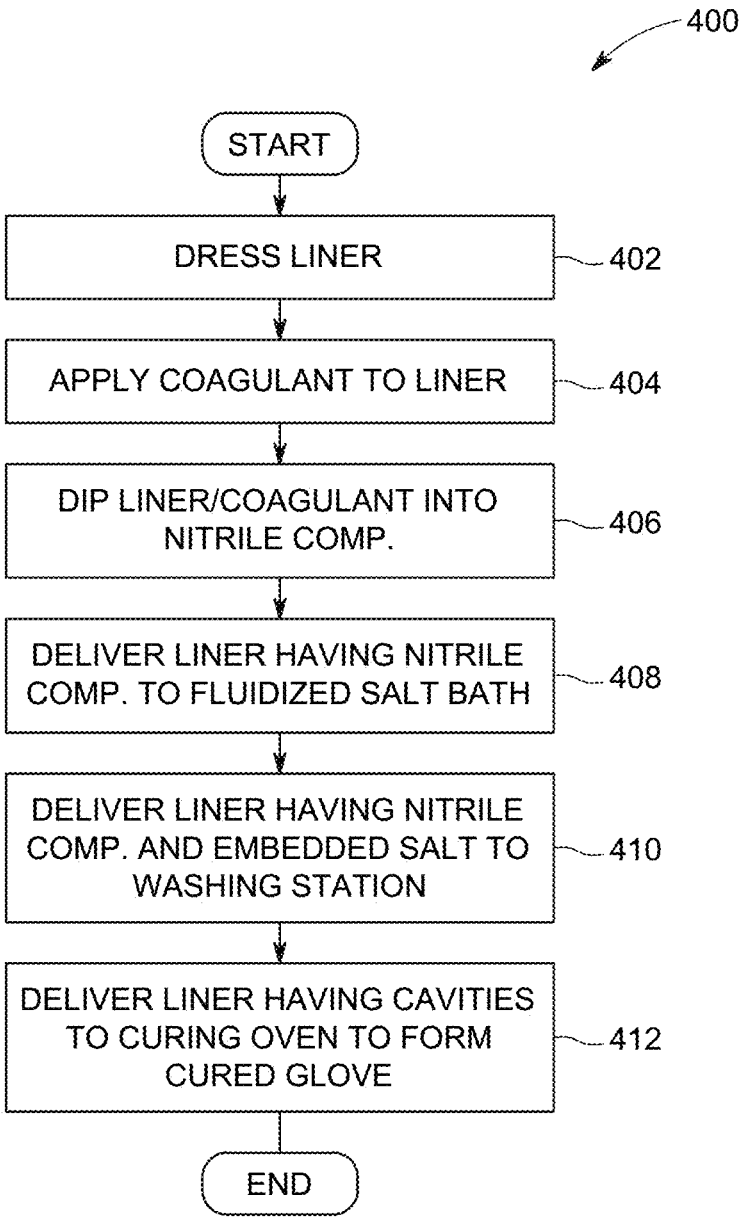
FIG. 4 is an exemplary flow diagram of a method for making a supported glove according to embodiments of the present invention.

FIG. 4 is an exemplary flow diagram of a method for making a glove according to embodiments of the present invention. The method 400 starts and at step 402, a fabric liner, such as the knitted liner 100 described above, is dressed onto a former. In embodiments of the present invention, a knitted fabric liner, for example, an 18-gauge liner having a thickness of 0.4-0.8 mm, comprising, for example, a nylon filament, a LYCRA® filament, glass fibers, and/or DYNEEMA®. At least one exemplary embodiment according to the present invention comprises an 18 gauge Ansell HYFLEX® glove or liner, knitted from an HPPE yarn, which is approximately 0.4 mm in thickness.

The method 400 proceeds to step 404, at which point a coagulant is applied to the fabric liner, which may comprise a spraying or other applying step. In some embodiments of the invention, the coagulant is applied to the fabric liner before dressing on a former. Typically, the dipping step comprises dressing the fabric liner on a hand shaped ceramic or metallic former and immersing the fabric liner in a coagulant solution. The coagulant solution penetrates the yarns of the fabric liner. Coagulant solutions comprise, for example, aqueous solutions comprising, for example, calcium salt(s), such as 3.5-7.0% calcium nitrate and/or calcium citrate, and 93-96.5% water.

At least one exemplary embodiment according to the invention includes a coagulant solution comprising a 1:1 blend of a strong acid and a weak acid, e.g., a calcium nitrate salt and e.g., acetic acid respectively. Also, at least one coagulant solution suitable for use with embodiments of the invention, which may be an aqueous or alcoholic coagulant solution, comprises approximately 5% calcium nitrate, approximately 5% acetic acid, and 90% water, alcohol, or a mixture of water and alcohol. Without intending to be bound by theory, it is believed that the coagulant combining a weak acid (e.g., acetic acid) and a strong acid (e.g., calcium nitrate), slowly gels the foamed composition disposed as a coating on the liner, promoting adherence of the coating with the liner, resulting in greater abrasion resistance. Moreover, slow gelation of an outer surface allows interior portions of the foamed coating applied to the liner to receive the strong coagulant. And, because the interior portion of the coating as well as the surface of the coating is allowed to gel slowly, the coating is not case hardened, i.e., is substantially through-hardened, and is therefore more abrasion-resistant. Also, as the coagulant coated liner contacts a polymeric composition, e.g., a nitrile composition, the composition is destabilized and forms a coating onto the fabric liner. Because the coagulant increases a solidifying action of the nitrile composition, the ingress of the nitrile composition into the interstices of the liner is impeded, i.e., chocking, thereby substantially preventing the entire penetration of the nitrile composition into the thickness of the knitted liner, preventing "strike-through," which results in an uncomfortable glove having a clammy feel. Other suitable strong coagulants include calcium chloride, calcium citrate, and the like, and other salts known to those in the art while other suitable weak coagulants include tricarboxylic acid, formic acid, and the like.

At step 406, the fabric liner is dipped into a nitrile composition, such as the foamed nitrile composition described above, forming a coating on the fabric liner. In some embodiments, the fabric liner is dipped into a composition to cover a portion of the fabric liner, such as a palm dip or three-quarters dip (in which parts of the backhand side of the liner are not fully covered with a coating). In some embodiments, the entire liner is dipped, e.g., a "full" dip. At least one exemplary embodiment of the invention comprises a coating approximately 0.4-0.6 mm in thickness.

At step 408, a texturization, using salt(s), is applied to a surface of the coating by introducing the fabric liner having the uncured coating disposed thereon into a fluidized salt bath to enhance grip properties and abrasion resistance properties. Technologies and methods describing texturization of the surface of the nitrile coating using salts are disclosed in commonly-assigned U.S. Pat. Nos. 7,378,043; 7,771,644; 7,814,570; and 8,522,363, which are incorporated by reference in entirety.

At least one embodiment according to the invention includes the use of salt particles ranging in mean particle size from about 200 microns to about 2600 microns, and optionally, wherein at least 95% of the sodium chloride particles are 200 microns+/−50 microns. Also, at least one embodiment according to the invention includes salt particles wherein at least 95% of the salt particles are 2500 microns+/−100 microns. In general, a smaller mean particle size will more deeply penetrate the uncured coating, resulting in greater cross-linking and, therefore, greater abrasion resistance.

The salt particles become embedded into the uncured foamed coating, for example, a nitrile composition, and destabilize, e.g., at least partially gel the nitrile molecules. The shape, generally a multi-faceted shape, of the salt particles remains on and in the foamed nitrile coating. When the salt is later removed by a solvent, such as water or an alkaline solution, a surface texture, having cavities that extend into the coating is created. The surface texture comprises the "negative" of the salt particles, creating a three-dimensional matte-like finish. Furthermore, the salt particles penetrate into the uncured foamed nitrile coating, so, in addition to creating a surface finish, craters and cavities are disposed well into the thickness of the coating. Moreover, the salt particles, in view of their small size, penetrate more deeply into a thickness of a foamed coating (as opposed to an unfoamed coating), thereby cross-linking more molecules, contributing to through-hardening, resulting in an even higher abrasion resistance. Also, salt particles that are the same size or smaller than the foam bubble sizes can also penetrate more deeply into the foamed coating, contacting more surface area and/or volume of the foamed coating, promoting additional cross-linking. Furthermore, without intending to be bound by theory, it is believed that smaller salt particles also create more cavities per unit area, providing better suction during the gripping of dry articles while wearing the gloves. In other words, the salt particles, in addition to penetrating the bubbles of the foam, also become embedded in any surface of the uncured foamed coating. It is further believed that the salt particles further promote the cross-linking of the NBR molecules of the coating, resulting in a more abrasion resistant coating. Also, again without intending to be limited by theory, it is believed that the salt, e.g., sodium chloride, forms relatively stronger ionic bonding with the polymer molecules of the coating, contributing to enhanced abrasion resistance.

While many salts, such as potassium chloride, calcium chloride, magnesium chloride, zinc chloride, calcium nitrate, zinc nitrate, or other compounds can be used to provide a textured appearance, sodium salts, such as sodium chloride, provide a distinct improvement in dry, wet and oil grip and chemical resistance of the textured surface of the present invention. Embodiments of the invention include a salt that is substantially soluble in a solvent, such as water, such as sodium chloride. Sodium chloride is inexpensive, readily available, easily disposed, recycled, and/or reused.

The method 400 then proceeds to step 410, at which point the coating is cured. In some embodiments, the coating is cured in an oven at, for example, 50° C. to 150° C. for approximately 10 to 120 minutes. In at least one exemplary embodiment of the invention, made from the foregoing method, the gloves having the coating disposed thereon is placed into an oven, for example, an infrared oven and heated to approximately 105° C. to 130° C. for approximately 5 to 30 minutes, forming a cured glove. In at least one embodiment according to the invention, curing is for approximately 7-8 minutes at 130° C. or, for example, 20 minutes at approximately 115° C. The method 400 then proceeds to step 412, at which point the embedded salt particles are removed from the coating using a solvent. The method 400 then ends.

Some steps of the preceding method 400 may be omitted or performed in a different sequence. For example, the salt particles may be removed before the curing step. Subjecting the uncured coating to a solvent can remove parts of the uncured coating. For example, two cavities may be adjacent one another. The area between two cavities is a relative high point. However, if the salt particles are removed with a solvent before the coating is cured, some of the coating, such as at the high points, may be removed, creating a channel between the cavities, allowing oil, water, etc., to traverse from cavity to cavity and creating a glove having even greater enhanced gripping capability. Moreover, additional steps may be employed, such as a subsequent washing step after curing. Optionally, a non-foamed coating is disposed on the liner and a foamed coating is disposed on the non-foamed coating via a second dipping step.

Figure 5:
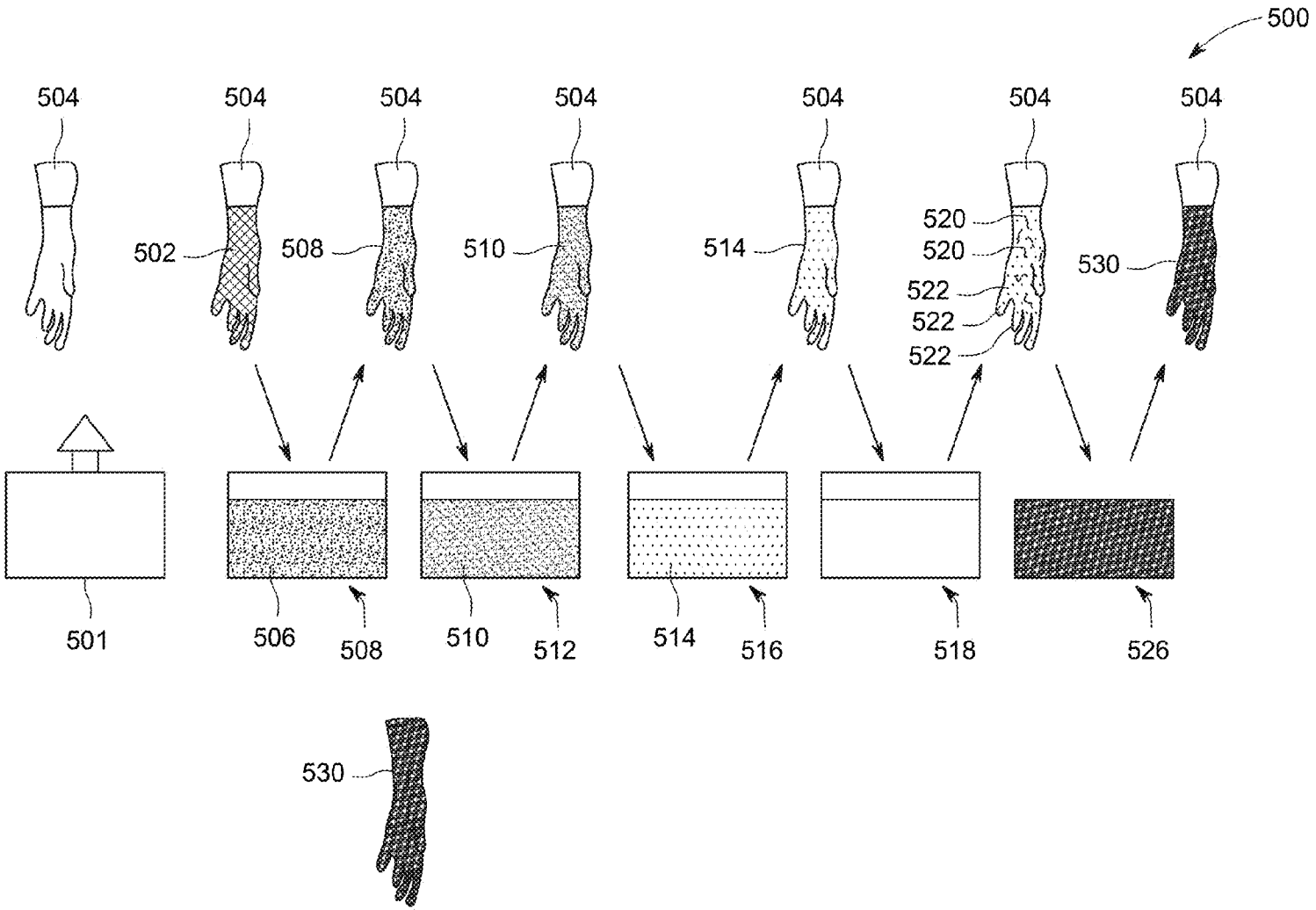
FIG. 5 depicts a diagram for a method and apparatus for producing a supported glove having a foamed polymeric layer, according to embodiments of the present invention.

FIG. 5 depicts a diagram for a method and apparatus 500 for producing a supported glove 504 having a foamed polymeric layer 510, according to embodiments of the invention. The apparatus 500 comprises a controller 501, which controls, for example, production line equipment, such as electronic circuits for controlling robots that deliver glove formers to tanks 508, 512, 516, and an oven 526. A former 504 is provided, upon which a knitted liner 502 is dressed. The former 504 having the knitted liner 502 dressed thereon is dipped into a tank 508 containing a coagulant 506, such as any coagulant described herein. Embodiments of the invention also comprise a knitted liner 502 and former 504 that is heated, for example, pre-heated to approximately 50-70° C., before dipping into the coagulant tank 508. The former 504 having the knitted liner 502 dressed thereon and with the coagulant 506 disposed on the knitted liner 502 is removed from the tank 508 and allowed to drip dry.

The former 504 having the knitted liner 502 dressed thereon and with the coagulant 506 disposed on the knitted liner 502 is then dipped into a tank 512, containing a foamed polymeric composition 510 and is removed therefrom. The former 504 having the knitted liner 502 now has an uncured foamed polymeric composition 510 disposed thereon and is delivered to a tank 516 containing a plurality of fluidized salt particles 514. The salt particles 514 become embedded throughout the uncured foamed polymeric composition 510 disposed on the knitted liner 502.

The knitted liner 502 on the former 504 having the foamed polymeric composition 510 and the salt particles 514 disposed thereon and therein is leached using room temperature or hot water in tank 518. The water in tank 518 removes the salt particles 514 from on the surface and throughout the foamed composition 510, leaving cavities 522 which may be the same size as the salt particles 514. In addition, the salt particles 514 penetrate the bubbles of the foamed polymeric composition 510, which are generally approximately 200 microns to 400 microns in diameter. The water bath may also remove part of the uncured foamed composition from the knitted liner 502, creating channels 520 between cavities 522 formed by the salt particles (now removed). The former 504 and the knitted liner 502 having the foamed composition 510, the cavities 522, and the channels 520 are then delivered to an oven 526, in which the foamed polymeric composition 510 is cured to form a glove 530. The glove 530 is then stripped from the former 504.

Gloves according to embodiments of the invention exhibit enhanced physical properties. For example, abrasion resistance and grip properties, such as dynamic and static coefficient of friction in different environments, such as wet, dry, oily of various gloves according to embodiments of the invention exhibit vastly increased performance over prior art gloves. The abrasion resistance, cut-resistance, and coefficient of friction properties of gloves according to embodiments of the invention are shown in Tables 2-4. Table 2 displays the EN 388:03 test method results, showing an average of more than 13,000 revolutions on an abrader before failure of the coating on the glove, corresponding to an EN performance level of 4+, a level not heretofore attained for a flexible, foamed nitrile glove. Table 3A displays the ASTM F1790-97, Cut Protection Performance Test (CPPT) results, e.g., cut-level 5, and Table 3B the EN 388:03 test method results for cut resistance.

TABLE 2

| | EN 388.03 Test Results (Revolutions) | | |
|---|---|---|---|
| | Test 1 | Test 2 | Test 3 |
| Sample 1 | 18000 | 14000 | 10000 |
| Sample 2 | 10000 | 19000 | 10000 |
| Sample 3 | 10000 | 17000 | 12000 |
| Sample 4 | 10000 | 12000 | 16000 |
| Average | 12000 | 15500 | 12000 |

TABLE 3A

| CPPT - ASTM F1790-97 | |
|---|---|
| average | 614 |
| minimum | 499 |
| maximum | 822 |
| std dev | 77 |
| CoV | 13% |
| # of tests | 44 |

TABLE 3B

| EN388 Cut | |
|---|---|
| average | 18.8 |
| minimum | 7.1 |
| maximum | 38.3 |
| std dev | 8.6 |
| CoV | 46% |
| # of tests | 36 |

Table 4 displays the results of static and kinetic coefficient of friction empirical testing as measured by ANSI D-1894 test protocols, showing that both static and kinetic coefficient of friction are approximately 2.5 to 3.5 times that of polyurethane gloves, Samples 1-2 and 17% greater than the Sample 3 polyurethane glove, providing a glove with significantly enhanced grip properties.

TABLE 4

| | Comparison of Coefficient of Friction | |
|---|---|---|
| | Static Coefficient | Kinetic Coefficient |
| Sample 1 | 0.4 | 0.19 |
| Sample 2 | 0.55 | 0.28 |
| Sample 3 | 1.27 | 0.89 |
| Present Invention | 1.48 | 0.99 |

Knitted liners, such as the knitted liner 100, in accordance with embodiments of the invention, comprise many different yarns and/or filaments to impart a variety of different properties to the liners made therefrom. For example, the liners described herein comprise cotton, wool, rayon, steel wire, glass fibers, filaments, ultra-high molecular weight polyethylene (UHMWPE), high-performance polyethylene (HPPE), DYNEEMA®, SPECTRA®, nylons, such as aliphatic nylons, e.g., nylon-6 or nylon-66, modacrylic yarns, oxidized-polyacrylonitrile (OPAN), meta-aramids, such as NOMEX®, para-aramids, such as KEVLAR®, TWARON®, VECTRAN®, and the like, or any blend of these fibers and materials. Any yarn according to embodiments of the invention optionally comprises a blend of yarns, such as can be created by ring spun, rotor spun, friction spun, braiding, and other processes for blending yarns. At least one exemplary yarn comprises a composite yarn, having a blended core yarn, that comprises about 90% high performance polyethylene stretch broken technical fibers, such as an HPPE yarn, and about 10% inorganic, mineral, ceramic, or filament fibers having a length substantially similar to a length of the high performance polyethylene stretch broken technical fibers; and at least one wrapping yarn comprising at least one of a high tenacity polyamide or a high tenacity polyester, wherein the at least one wrapping yarn is wrapped around the core to form the composite yarn having an EN5 cut-resistance level and having dimensions that enable the composite yarn to be knitted with an 18 gauge needle.

Yarns used for cut-resistance include steel wire, glass fibers, ultra-high molecular weight polyethylene, NOMEX®, TWARON®, KEVLAR®, and DYNEEMA®. Other yarns provide dexterity and fit properties, such as elastane, stretchable yarns, for example, SPANDEX® and LYCRA®. At least one exemplary yarn used in knitted liners according to the invention comprises a blended yarn that comprises nylon fibers and/or filaments, elastane fibers and/or filaments and p-aramid fibers and/or filaments. Also, another exemplary yarn according to embodiments of the invention further comprises stainless steel blended with nylon, elastane, and p-aramid fibers and/or filaments. Knitted liners according to embodiments of the invention comprises yarns capable of moisture management, e.g., nylons, nylons having irregular cross-sections, STA-COOL® polyesters, HYDROTEC®, AQUARIUS®, and DRYENERGY®, which are capable of withdrawing moisture and perspiration from the skin and also provide comfort. Furthermore, moisture and perspiration controlling yarns may also comprise antimicrobial agents, which are helpful in attenuating odors and/or preventing wounds and burns from becoming infected. Anti-microbial agents comprise surface coatings applied on or within the yarn(s), such as silane quaternary ammonium and/or N-Halamine compounds, TRICLOSAN®, as well as elemental silver and silver-releasing compounds.

Methods for manufacturing the glove include knitting one or more yarns that are capable of being knitted with at least one 18 gauge needle. For example, yarns that are 0.18 mm in diameter or smaller may be knitted by at least one 18 gauge needle because by definition an 18 gauge needle. An 18-gauge V-bed knitting machine has 18-gauge needles spaced such that there are 18 needles per inch. Similarly, a 15-gauge needle machine has 15-gauge needles spaced such that there are 15 needles per inch, i.e., 18 gauge needles are smaller than 15 gauge needles. Depending on the density of the yarn, a yarn that is approximately 221 denier or less may be knitted using an 18 gauge needle. Yarns are sometimes described in terms of denier, the definition of which is the weight in grams per 9000 meters of the yarn and, therefore, yarns having differing densities will have different diameters. For example, using the following formula, the denier of a yarn is correlated with the diameter of the yarn, taking the density of the yarn into consideration: Diameter=SQRT $((4.45\times10^{-6}\times\text{Denier})/(\text{PI}\times\text{Density}))$. In this example, the diameter of a nylon 6,6 yarn of 280 denier=Diameter=SQRT $((4.45\times10^{-6}\times280\text{ g}/9000\text{ m})/(3.1415\times1.14\text{ g/cm}^3))\times10{,}000$ (to convert from cm to microns)=186. In this case, a yarn 186 microns in diameter cannot reliably be knitted using 18 gauge needles because such a yarn cannot fit into the needle hook. However, a denser yarn, or a yarn having a lesser denier, for example, 221 denier, having commensurately smaller diameters, may be knitted using 18 gauge needles. Popular yarns used in knitting liners for gloves, alone or in blends and/or in plaited liners, include ultra-high molecular weight polyethylene, which has a density of 0.97 g/cm$^3$ and a denier of 221, produces a yarn having a diameter of 180 microns, which is small enough to be knitted using 18 gauge needles. Nylon 6,6, which has a density of 1.14 g/cm$^3$ and a 221 denier, producing a yarn having a diameter of 166 microns. Polyesters, such as elastane yarns, e.g., SPANDEX or LYCRA, having a density of 1.38 g/cm$^3$ and a denier of 221, producing a yarn having a diameter of 151 microns. Aramids, such as a p-aramid yarn, e.g., KEVLAR, having a density of 1.44 g/cm$^3$ and a denier of 221, producing a yarn having a diameter of 147 microns.

Nitrile compositions, such as those described in Table 1, may also comprise various accelerants, stabilizers, pigments, and other components such as anti-microbial agents, fillers/additives, and the like. In some embodiments, the composition comprises additives, such as bentonite and other clays, minerals, silica, acrylics, and/or like thickeners, to control the rheological properties of the compositions, as is known to those in the art. The composition of one or more embodiments may also include a cure package or vulcanization agents to promote cross-linking during the curing process, such as sulfur and/or other suitable crosslinking agents, such as dithiocarbamates, thiazoles, or thioureas. In some embodiments, the accelerator comprises at least one of zinc dibutyl dithiocarbamate (ZDBC), zinc 2-mercaptobenzothiazole (ZMBT), N—N'-diphenylthiourea (DPTU), zinc diethyl dithiocarbamate (ZDEC), or sodium dibutyl dithiocarbamate (SDBC), diphenyl guanidine (DPG), and/or activators, such as zinc oxide, known to those in the art.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention.

Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements and patterns may be devised without departing from the spirit and scope of the present invention as defined by the following claims. Furthermore, the particular features, structures, materials, or characteristics may be combined in any suitable manner in any one or more of the embodiments.

Publications and references, including but not limited to patents and patent applications, cited in this specification are herein incorporated by reference in their entireties as if each individual publication or reference were specifically and individually fully set forth herein. Any patent application to which this application claims priority is also incorporated by reference herein in the manner described above for publications and references.

All numerical values recited herein are exemplary, are not to be considered limiting, and include ranges therebetween, and can be inclusive or exclusive of the endpoints. Optional included ranges can be from integer values therebetween, at the order of magnitude recited or the next smaller order of magnitude. For example, if the lower range value is 0.1, optional included endpoints can be 0.2, 0.3, 0.4 . . . 1.1, 1.2, and the like, as well as 1, 2, 3 and the like; if the higher range is 10, optional included endpoints can be 7, 6, and the like, as well as 7.9, 7.8, and the like.

While the foregoing is directed to embodiments of the present invention, other and further embodiments of the invention may be devised without departing from the basic scope thereof, and the scope thereof is determined by the claims that follow.

What is claimed is:

1. A thin, flexible abrasion resistant glove, comprising:
an 18 gauge knitted liner;
a foamed nitrite coating adhered to at least a portion of the knitted liner; and
a plurality of cavities disposed on a surface and within the foamed nitrile coating, wherein the glove exhibits at least an EN level 4 abrasion resistance, wherein the glove has a thickness in the amount of 0.9 to 1.1 mm.

2. The thin, flexible abrasion resistant glove of claim 1, wherein the foamed nitrile coating comprises an open-cell foam.

3. The thin, flexible abrasion resistant glove of claim 1, wherein the foamed nitrile coating comprises a closed-cell foam.

4. The thin, flexible abrasion resistant glove of claim 1, wherein the plurality of cavities range in size from 200-400 microns.

5. The thin, flexible abrasion resistant glove of claim 1, wherein the plurality of cavities comprise at least one of irregularly-shaped cavities and circularly-shaped cavities.

6. The thin, flexible abrasion resistant glove of claim 1, wherein the 18 gauge knitted liner comprises HPPE fibers and glass fibers.

7. The thin, flexible abrasion resistant glove of claim 1, wherein the 18 gauge knitted liner comprises p-aramid fibers, m-aramid fibers, nylon filaments, and/or elastane filaments.

8. The thin, flexible abrasion resistant glove of claim 1, wherein the glove exhibits at least an EN level 5 cut resistance.

9. The thin, flexible abrasion resistant glove of claim 1, wherein the thickness of the 18 gauge knitted liner ranges from 0.4 to 0.8 mm.

10. A thin, flexible abrasion resistant glove, comprising:

an 18 gauge knitted liner;

a foamed nitrile coating adhered to at least a portion of the knitted liner; and a plurality of cavities disposed on a surface and within the foamed nitrile coating, wherein the glove exhibits at least an EN level 4 abrasion resistance, and wherein the glove exhibits at least an EN level 5 cut resistance.

11. The thin, flexible abrasion resistant glove of claim 10, wherein the thickness of the foamed nitrile coating ranges from approximately 0.2 to 0.6 mm.

12. The thin, flexible abrasion resistant glove of claim 10, wherein the thickness of the 18 gauge knitted liner ranges from 0.4 to 0.8 mm.

13. The thin, flexible abrasion resistant glove of claim 10, wherein the thickness of the glove ranges from 0.9 to 1.1 mm.

14. The thin, flexible abrasion resistant glove of claim 10, wherein the foamed nitrile coating comprises an open-cell foam.

15. The thin, flexible abrasion resistant glove of claim 10, wherein the foamed nitrile coating comprises a closed-cell foam.

16. The thin, flexible abrasion resistant glove of claim 10, wherein the plurality of cavities range in size from 200-400 microns.

17. The thin, flexible abrasion resistant glove of claim 10, wherein the plurality of cavities comprise at least one of irregularly-shaped cavities and circularly-shaped cavities.

18. The thin, flexible abrasion resistant glove of claim 10, wherein the 18 gauge knitted liner comprises HPPE fibers and glass fibers.

* * * * *